United States Patent [19]

DiPersio et al.

[11] Patent Number: 4,776,593

[45] Date of Patent: Oct. 11, 1988

[54] VCR BASEBALL GAME

[76] Inventors: Marsha DiPersio; Anthony DiPersio, both of 36 Hart St., Woburn, Mass. 01801

[21] Appl. No.: 101,868

[22] Filed: Sep. 25, 1987

[51] Int. Cl.[4] ..... A63F 7/06

[52] U.S. Cl. ..... 273/93 C; 273/93 R; 273/DIG. 28

[58] Field of Search ..... 273/93 R, 93 C, 298, 273/DIG. 28

[56] References Cited

U.S. PATENT DOCUMENTS

| | | | |
|---|---|---|---|
| 1,153,899 | 9/1915 | Elcouin | 273/93 C UX |
| 2,283,578 | 5/1942 | Rogers | 273/93 R X |
| 2,788,213 | 4/1957 | Hull | 273/93 C |
| 2,812,181 | 11/1957 | Richman | 273/93 C |
| 3,528,661 | 9/1970 | Warner | 273/93 C |
| 4,210,335 | 7/1980 | Licciardi | 273/93 CX |
| 4,261,569 | 4/1981 | Frohlich | 273/93 R |
| 4,662,635 | 5/1987 | Enokian | 273/94 |

*Primary Examiner*—Anton O. Oechsle
*Attorney, Agent, or Firm*—H. Jay Spiegel

[57] ABSTRACT

Disclosed herein is a new board game designed to combine the use of a die and playing cards along with a VCR to play a simulated game of baseball. The single die determines strikes, balls and hits while hit cards determine whether a hit is a single, double, triple or home run, whether the player is out or whether one must play a VCR tape having recorded thereon a plurality of actual baseball plays to determine what will transpire. Other aspects are disclosed herein.

5 Claims, 1 Drawing Sheet

Fig. 1
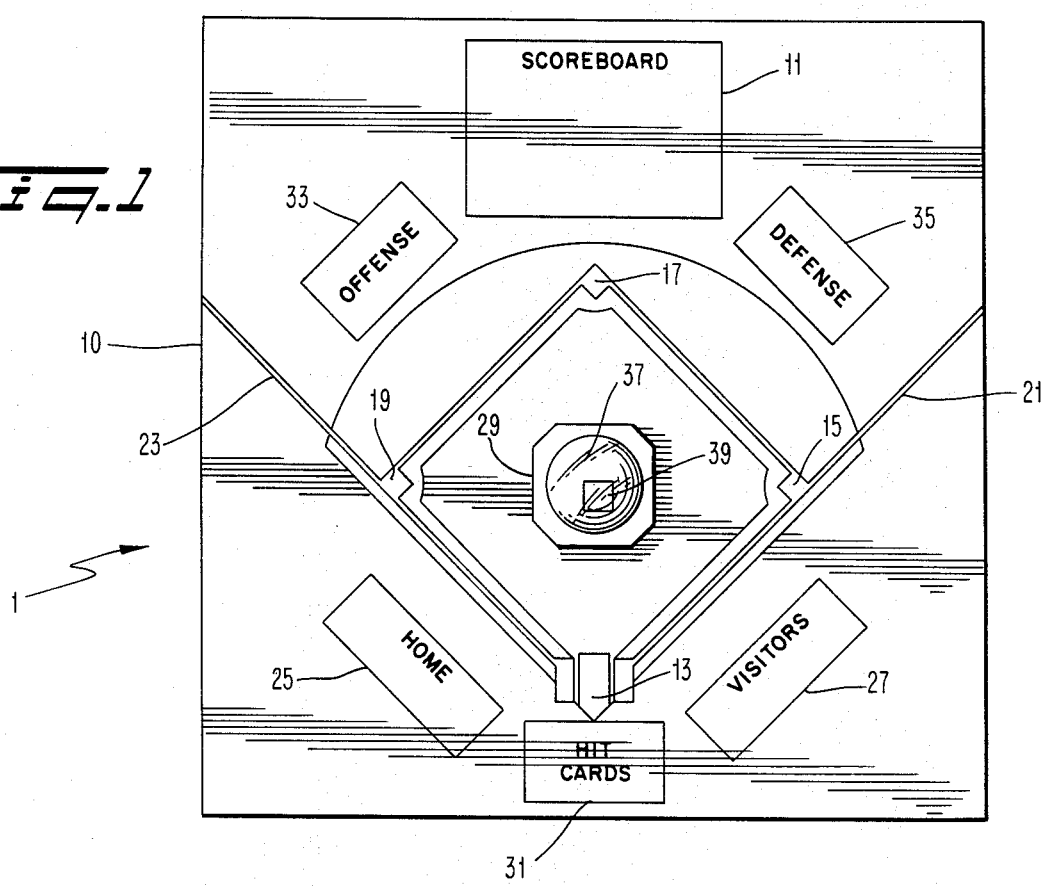
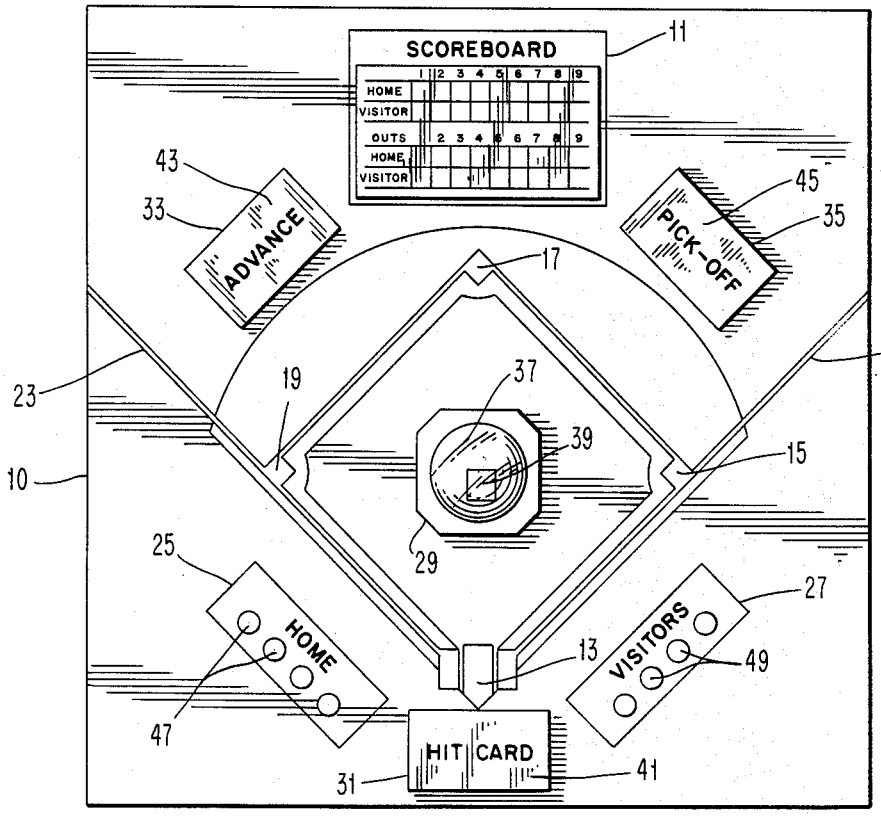
Fig. 2

VCR BASEBALL GAME

BACKGROUND OF THE INVENTION

In the prior art, many examples of board games revolving around the game of baseball are known. U.S. Pat. Nos. 2,933,316 to Mancini, 4,000,897 to York, 4,210,335 to Licciardi and 4,653,755 to Panella, et al. each disclose a board game simulating the game of baseball. These games variously utilize chance devices such as cards picked at random, spinners and dice to determine the play of the game. However, none of these games includes the concept of utilizing a video tape pre-recorded with various baseball plays to be used in playing the game. As such, a need has developed for a game which may be played on a board, may simulate the game of baseball and in which the playing of a pre-recorded video tape at certain predetermined times during the game assists in determining the outcome thereof.

SUMMARY OF THE INVENTION

The present invention overcomes the deficiencies found in the prior art as described above and provides a new and improved board game simulating the game of baseball. The game includes the following interrelated aspects and features:

(a) In a first aspect, the present invention includes a game board having the depiction of a baseball field printed thereon including home and visitors' dugout, home plate, first, second and third base, a pitcher's mound, baselines and an outfield area as well as a scoreboard.

(b) The scoreboard may be utilized to keep score during the playing of the game through the use of tokens or, alternatively, may be made of an easily erasable surface so that erasable writing may be utilized in the scoring.

(c) On the pitcher's mound is located a device for mixing a single die contained therein with this device being well known in the prior art and being identified by the name "popomatic". This device has been used in other board games such as the game "Trouble". Of course, other alternative devices may be utilized to mix the die, however, the "popomatic" is particularly convenient for the present game since it neatly fits on the area of the pitcher's mound.

(d) A single die is contained within the "popomatic" and is of cubical configuration having six faces with two opposed faces having the word "hit" thereon, with two opposed faces having the word "strike" thereon and with two opposed faces having the word "ball" thereon. As is well known, a strikeout consists of three strikes and a walk consists of 4 balls. Thus, through sequential rolling of the die, the player at bat will gain strikes, balls or a hit.

(e) When the die is rolled and comes up "hit" the player must then take a "hit card". The hit cards are located below home base and have certain instructions written thereon as will be described in greater detail hereinafter, including the nature of the hit, whether the player is out or, importantly, may include the letters VCR thereon.

(f) If the letters VCR appear on the hit card, a video tape which is contained in a VCR machine adjacent the playing board must be played. The video tape is pre-recorded with a large number of actual baseball plays from major league or other level games which have appeared on television or elsewhere. The single play is played on the video tape and play is continued in accordance with what has transpired on the tape as will be described in greater detail hereinafter.

(g) The game further includes the use of "advance" and "pick-off" cards which will be described in greater detail hereinafter.

Accordingly, it is a first object of the present invention to provide an improved VCR baseball game.

It is a further object of the present invention to provide an improved VCR baseball game which includes a board simulating a baseball field having a plurality of different types of cards stored thereon.

It is a still further object of the present invention to provide such a game including the use of an associated video cassette recording machine to play pre-recorded video tapes depicting various baseball plays.

These and other objects, aspects and features of the present invention will be better understood from the following detailed description of the preferred embodiment when read in conjunction with the appended drawing figure.

BRIEF DESCRIPTION OF THE DRAWINGS

FIG. 1 shows a view of the inventive board without piles of cards and game tokens placed thereon.

FIG. 2 shows the board of FIG. 1 with the various cards and game tokens placed thereon.

SPECIFIC DESCRIPTION OF THE PREFERRED EMBODIMENT

With reference, first, to FIG. 1 it is seen that the inventive game 1 includes a board 10 including a scoreboard 11, home plate 13, bases 15, 17, 19, baselines 21 and 23, home dugout 25, visitors' dugout 27 and a pitcher's mound 29.

Additionally, three rectangular areas are printed on the board 10 including the area 31 on which is printed "hit cards", the area 33 on which is printed "offense" and the area 35 on which is printed the word "defense". Finally, on top of the pitcher's mound 29 a device known as a "popomatic" 37 is mounted and has contained therein a single die 39. The popomatic operates in a manner well known to the those skilled in the art wherein the top portion thereof may be depressed so that the die 39 is rotated and mixed at random.

The die 39 is of cubical shape and includes six faces thereon including two opposed faces having the word "strike" printed thereon, two further opposed faces having the word "ball" printed thereon, and finally, two opposed faces having the word "hit" printed thereon. If desired, the pairs of faces having the same word thereon may be adjacent to one another rather than on opposed faces.

With reference to FIG. 2, it is seen that on the space 31, a pile of hit cards 41 may be placed. Further, on the space marked "offense", a pile of advance cards 43 may be placed. Further, on the space marked "defense" a pile of "pick-off" cards may be placed. Further, on the home dugout 25, a plurality of home tokens 47 of a predetermined color may be placed while on the visitors dugout 27 a plurality of visitors' game tokens 49 preferably of a different color may be placed.

Finally, as seen in FIG. 2 the scoreboard 11 may have printing thereon depicting the scoring and number of outs which have been made in each inning. The scoreboard may be made of easily erasable material so that the information may be written thereon to be easily erased later. Otherwise, tokens "not shown" may be utilized to mark the score and other information.

With the game board having been described in great detail along with other game items placed and mounted thereon, the manner of playing the inventive game will now be described.

In order to play the game, the board as shown in FIG. 1 is set up with the cards and tokens in the manner depicted in FIG. 2. As is the case during a normal baseball game, the visiting team bats first and if the game is tied or the home team is behind going into the last half of the last inning, the home team will bat then. The visiting team places one token 49 at home plate and depresses the bubble on the popomatic 37 thus mixing the die 39. Strikes and balls are kept track of on the scoreboard 11 if desired and as in the usual game of baseball, if four balls are rolled prior to three strikes having been rolled, the token 49 is advanced to first base 15. If on the other hand three strikes are rolled prior to four balls being rolled, the batter is out and such is noted on the scoreboard 11. Finally, if before three strikes or four balls the die 39 comes up "hit", that player takes a hit card 41 from the top of the pile. Hit cards may include designation of the type of hit such as "single", "double", "triple", or "home run". Additionally, the hit cards may have printed thereon "batter out", "sacrifice fly" or the hit card 41 may have printed thereon "VCR".

In setting up the game as shown in FIG. 2, adjacent to the game board 10, a video cassette recorder machine is plugged in and set up and a tape is inserted therein for play. The tape has pre-recorded thereon a large number of actual plays from baseball games which have been broadcast on television or have been recorded live. Thus, a single VCR tape may hold hundreds of snippets of baseball games each of which contains a single actual play. Thus, in this way, when the tape is played depicting a single play, the situation as depicted on the tape is utilized in a corresponding way in the game.

Any inconsistencies between the situation as depicted on the game board and as depicted on the VCR tape are resolved through the use of common sense. Thus, for example, if the situation on the board is that no one is on base and there are no outs and the VCR tape depicts a man on first base and the batter hitting into a double play, through the use of common sense, it is apparent that that situation would be applied to the game board in such a manner that the hitter is out. If the tape depicts a runner on third base and a sacrifice fly scoring the runner and conversely on the game board a runner is on second, common sense dictates that the sacrifice fly will move that runner to third base. Thus, through the use of common sense, the situation depicted on the tape may easily be transformed into the situation which exists on the game board.

Additionally, at the start of the game the home team which plays the field first will pick one "pick-off" card and the visiting team which bats first will pick one "advance" card. Advance cards are used when a man or men is/are on base and a fly ball out is hit either by a hit card or on the VCR tape. The advance card is always maintained face down and the team holding the advance card does not know what is printed on the reverse side. In such a situation as depicted above wherein a fly ball out is hit, the offensive team has the option of turning over the advance card to read the instructions printed thereon. The instructions may include advancing the men one base, staying at the base, etc.

If desired, when the offensive team has chosen to turn over their advance card, the team on defense may choose to turn over their "pick-off" card. The pick-off card is also instructional and will decide what will happen to those men who are on base for whom instructions have been given by the advance card. Pick-off cards may include the instruction such as "safe", "tag-out", "picked-off second base", and the like. It should be understood that the pick-off card is only turned over in situations where the advance card has been turned over. Furthermore, after each inning whether or not the advance cards and pick-off cards have been turned over, they are put in a discard pile and new such cards are picked each turn.

As should be understood, if men are on base and the batter gets a hit, the men on base are advanced only as many bases as the man who hit the ball. Thus, while in a normal baseball game, with a runner on second base a long single usually scores the runner, however, in this game, a single would only advance the runner on second base to third base.

In the preferred embodiment, the game is played for seven full innings and if the game is tied at the end of seven full innings, play continues until the next run scores with the home team always having the last at bats.

Accordingly, a game has been described in terms of a preferred embodiment thereof which fulfills each and every one of the objects as set forth hereinabove and provides a new and interesting game which may be played by players of all ages. Of course, various changes, modifications and alterations in the teachings of the present invention may be contemplated by those skilled in the art without departing from the intended spirit and scope thereof. Accordingly, it is intended that the present invention only be limited by the terms of the appended claims.

We claim:

1. An improved game comprising (a) a board having a design designed to resemble a baseball field and including representations of dugouts, bases, infield and outfield;

(b) a chance device capable of randomly displaying various information related to the playing of a baseball game including the indications of hits by a bat, strikes and balls, and a stack of cards one card of which is picked when the chance device indicates a hit by a bat, said cards being variously provided with indicia indicating types of said hits and indicia indicating thet a video cassette playing device be played;

(c) a video cassette having recorded thereon actual baseball plays recorded during the playing of or simulated playing of an actual baseball game, said cassette being adapted to be loaded into a video cassette playing device;

(d) wherein the object of the game is to score the most runs in a predetermined number of innings, the chance device controls walks, strikeouts and said hits, and, responsive to said chance device indicating a said hit, and the picking of one card from said stack of cards, when said card so indicates, playing a play on said playing device from said cassette and playing said game in correspondence with said play.

2. The invention of claim 1, further wherein said stack of cards are termed "hit" cards, each said "hit" card having instructions printed thereon including "single", "double", "triple", "home run" and "VCR", and when a card is chosen with "VCR" printed thereon, said cassette is played.

3. The invention of claim 2, further including a second stack of cards termed "advance" cards, one of said "advance" cards being drawn by a team at bat and being turned over in situations where at least one man is on base and a "hit" card has resulted in a sacrifice fly being hit, said "advance" card instructing a player as to whether said at least one man may advance one or more bases.

4. The invention of claim 3, further including a third stack of cards termed "pick-off" cards, one of said "pick-off" cards being drawn by a team in the field and being turned over in situations wherein a said "advance" card has been turned over, said "pick-off" cards having instructions printed thereon as to the fate of players advancing through instructions printed on a turned over "advance" card.

5. The invention of claim 1, wherein said chance device comprises a die having plural faces, said faces having printed thereon the words "hit", "strike" and "ball".

* * * * *